US006798279B2

(12) United States Patent
Ebner

(10) Patent No.: US 6,798,279 B2
(45) Date of Patent: Sep. 28, 2004

(54) INTEGRATED CIRCUIT ARRANGEMENT WITH A CASCODED CURRENT SOURCE AND AN ADJUSTING CIRCUIT FOR ADJUSTING THE OPERATING POINT OF THE CASCODED CURRENT SOURCE

(75) Inventor: Christian Ebner, Munich (DE)

(73) Assignee: Xignal Technologies AG, Unterhaching (DE)

( * ) Notice: Subject to any disclaimer, the term of this patent is extended or adjusted under 35 U.S.C. 154(b) by 0 days.

(21) Appl. No.: 10/445,622

(22) Filed: May 27, 2003

(65) Prior Publication Data

US 2004/0104765 A1 Jun. 3, 2004

(30) Foreign Application Priority Data

May 27, 2002 (DE) ..... 102 23 562

(51) Int. Cl.[7] ..... G05F 1/10
(52) U.S. Cl. ..... 327/543
(58) Field of Search ..... 323/312, 315, 323/316; 327/530, 534, 535, 537, 538, 540, 542, 543

(56) References Cited

U.S. PATENT DOCUMENTS 4,583,037 A * 4/1986 Sooch ..... 323/315
4,897,596 A * 1/1990 Hughes et al. ..... 323/315
5,680,038 A * 10/1997 Fiedler ..... 323/315
5,959,446 A * 9/1999 Kuckreja ..... 323/315
6,531,923 B2 * 3/2003 Burns ..... 330/296

FOREIGN PATENT DOCUMENTS

EP 0 643 347 A1 3/1995

* cited by examiner

*Primary Examiner*—Jeffrey Zweizig
(74) *Attorney, Agent, or Firm*—Pearne & Gordon LLP

(57) ABSTRACT

An integrated circuit arrangement is provided according to the present invention, including a cascoded current source (10) and an adjusting circuit (20) for adjusting the operating point (Vg1, Vg2, Vx) of the cascoded current source (10) by providing gate potentials (Vg1, Vg2) for current source FETs (Q1, Q2), the adjusting circuit having: a reference stage, formed by a pair of reference FETs (M2, M1), which are supplied with reference currents (Iref1, Iref2) in such a way that the current densities in the reference FETs (M2, M1) differ by a predetermined factor ($N^2$), for providing reference gate potentials (Vgs1, Vgs2) at the gates of the reference FETs (M2, M1); a processing stage, for providing an adjustment potential (Vgt1+V1) on the basis of the predetermined factor ($N^2$), which is equal to the effective control voltage (Vgt1) of the first reference FET (M2) plus a predetermined additional voltage (V1), and an output FET (M9), which is connected on the source side to the adjustment potential (Vgt1+V1). Therefore, the present invention provides a circuit for operating point adjustment of a cascoded FET current source, independent of process and temperature variations, which may be used in many highly integrated analog circuits and maximizes the dynamic range.

7 Claims, 2 Drawing Sheets

Figure 3:
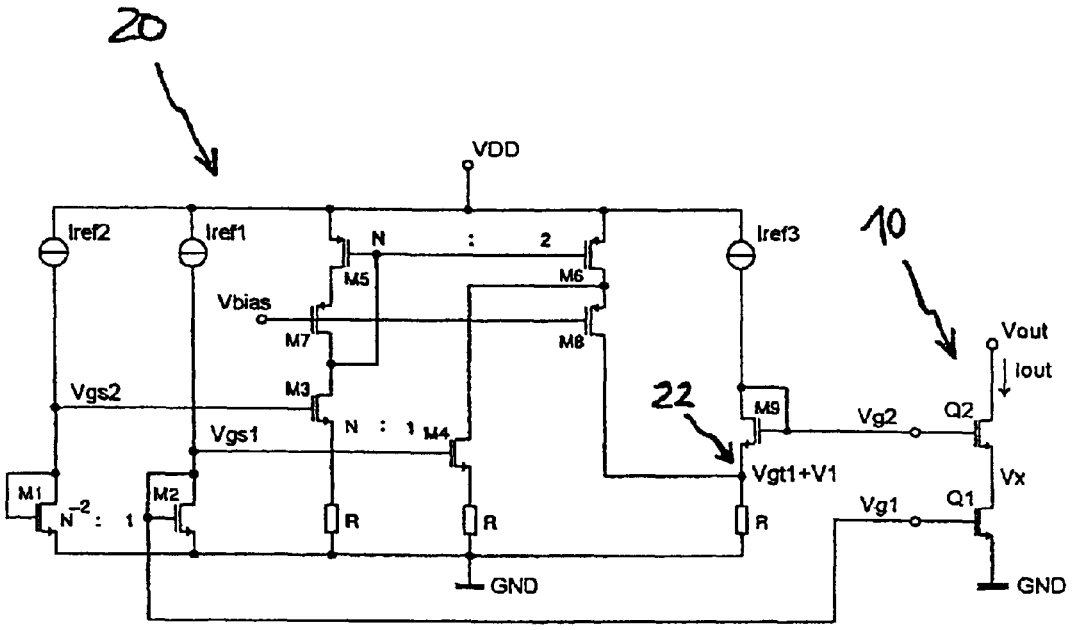

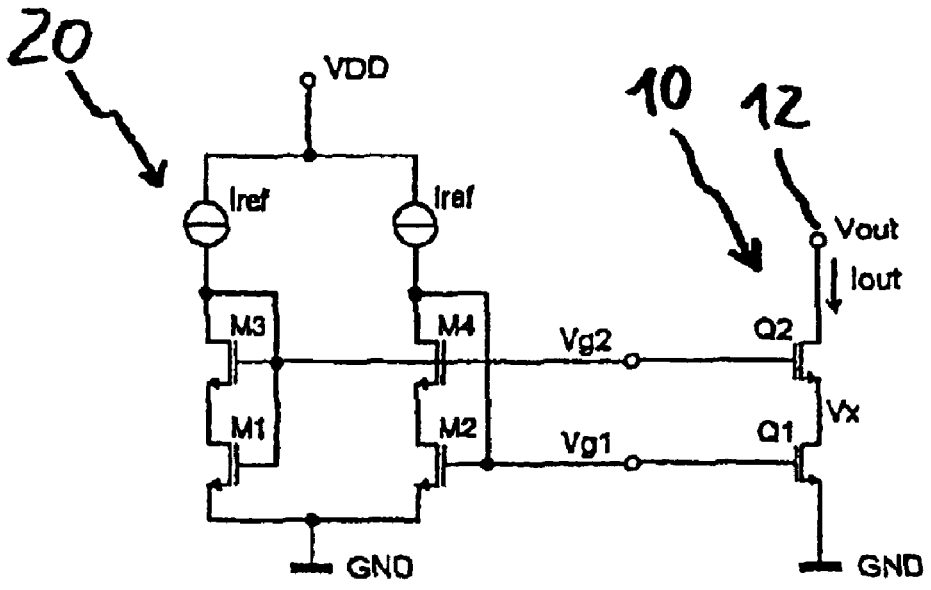
Fig. 1
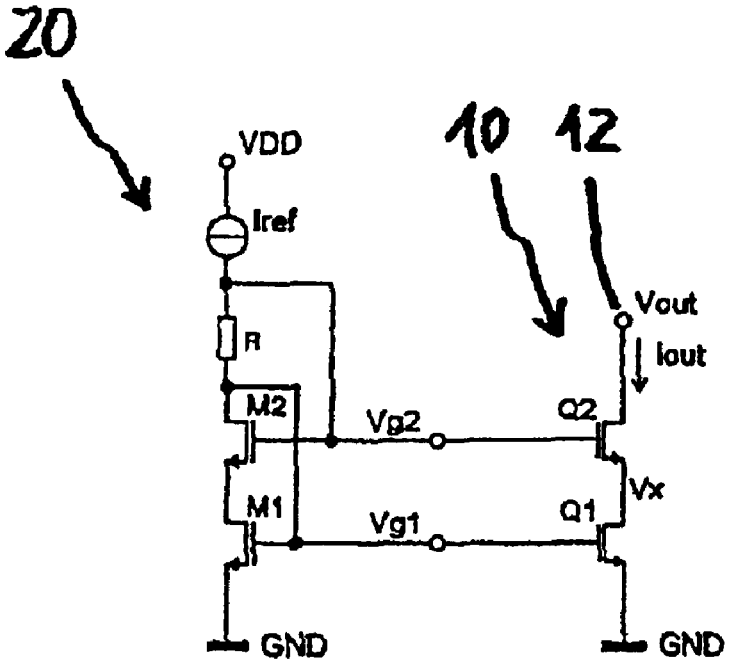
Fig. 2 Related Art

INTEGRATED CIRCUIT ARRANGEMENT WITH A CASCODED CURRENT SOURCE AND AN ADJUSTING CIRCUIT FOR ADJUSTING THE OPERATING POINT OF THE CASCODED CURRENT SOURCE

The present invention relates to an integrated circuit arrangement having a cascoded current source and an adjusting circuit for adjusting the operating point of the cascoded current source.

A circuit arrangement based on internal knowledge of the applicant is shown in FIG. 1. The right part of FIG. 1 shows a cascoded current source 10, provided in an integrated circuit, which is formed in a way known per se from a first current source FET Q1 and a second current source FET Q2 (cascode). Further parts of the integrated circuit (not shown here) are connected to an output node 12. The current source 10 provides an output current Iout at this output node 12 (drain of the cascode FET Q2), whose value is a function of the properties of the FETs Q1, Q2 and of gate potentials Vg1, Vg2, which are provided by the adjusting circuit 20 shown in the left part of the figure and are applied to the gates of the FETs Q1 and Q2. It is essential for the operation of the current source 10 that the FETs Q1, Q2 always be operated in saturation, so that, in a way known per se, the output current Iout is barely a function of the voltage Vout at the output node. In other words, the current source 10 advantageously has a very high output impedance in this case. An FET is saturated when the drain-source voltage Vds is greater than the effective control voltage Vgt, Vgt being defined as the gate-source voltage minus the threshold voltage: Vgt=Vgs−Vth.

In comparison to a "simple current source" (without the cascode FET Q2), the current source 10 shown has a reduced output voltage swing, i.e., the permissible range for the output voltage Vout for operation of the current source is restricted by the drain-source voltage of Q2 in addition to the drain-source voltage of Q1. In order to keep this reduction of the voltage swing caused by the cascading as small as possible, the drain voltage Vx of the first current source FET Q1, which is equal to the source voltage of the second current source FET Q2, is to be adjusted as closely as possible to the saturation limit of Q1. Possible measures for this adjustment are explained in the following on the basis of FIGS. 1 and 2.

The left part of FIG. 1 shows the circuit 20 for operating point adjustment of the cascoded current source Q1, Q2. An FET M1, operated in the linear range, is used in the circuit in order to define the source voltage of cascode FETs M3, M4. This source voltage results as the voltage drop at FET M1, which is used here as a resistor element. Since the diode-switched FET M3 and the cascode M4 are identically dimensioned in regard to channel length and current density and both have the gate voltage Vg2, an equal source voltage, defined by M1, results at the cascodes M3, M4. For example, the FETs M3 and M4 may be identically dimensioned and each have a reference current Iref of equal size applied to them. This source voltage of the cascodes must be selected in this case in such a way that M2 is always sufficiently in saturation, i.e., its drain voltage (the source voltage of the cascodes) is always somewhat greater than its effective control voltage. The dimensioning of Q1 in comparison to M2 finally determines a "translation ratio" for the current Iout in relation to the current which flows through M2. The current densities in Q1 and M2 are identical. Correspondingly, if Q1 and M2 are dimensioned identically, Iout=Iref. The adjusting circuit 20 finally ensures that the source voltage Vx of the cascode Q2 is greater than the effective control voltage Vgt of the FET Q1.

FIG. 2 shows a further circuit 20 for operating point adjustment of a cascoded current source 10. The circuit generates the gate voltage Vg2 of cascodes M2, Q2 in another way, specifically in that the voltage which drops at a resistor R is added to the diode voltage of an FET M1 operated in saturation. The resistor R is selected in this case in such a way that the source voltage Vx of the cascode Q2 is in turn somewhat greater than the effective control voltage Vgt of M1. This voltage Vx is equal to the second gate potential Vg2 minus the gate-source voltage of M2. The circuit shown in FIG. 2 is known from European Patent Application EP 0 643 347 A1 and is described there as advantageous for achieving a high output impedance while simultaneously having relatively low current consumption.

In practice, the disadvantages described in the following result for the circuit arrangement shown in FIG. 2. In order to ensure the function of the cascoded current source 10, it is necessary for the drain voltage Vx of the first current source FET Q1 to be kept greater than its effective control voltage Vgt. In order to ensure this over the process variations during the manufacture of the integrated circuit and temperature variations during operation of the integrated circuit, a certain safety reserve is also typically added to the necessary drain voltage (Vgt). However, this safety reserve leads to yet a further restriction of the usable dynamic range (output voltage swing) of the current source, which is a grave disadvantage in consideration of the supply voltages for integrated circuits, which are becoming smaller and smaller.

It is therefore an object of the present invention to allow, in an integrated circuit, adjustment of the operating point of a cascoded current source, in which the voltage (Vx) on the drain of the first current source FET may be adjusted as near as possible to the saturation limit (Vgt) of this FET, independently of process variations and temperature variations.

This object is achieved by an integrated circuit arrangement having the features of Claim 1. The dependent claims relate to advantageous refinements of the present invention, which may each be provided alone or, especially advantageously, also combined with one another.

With the circuit arrangement according to the present invention, it is possible to adjust the voltage at the drain of the first current source FET (Q1) and/or the voltage at the source of the second current source FET (Q2) in such a way that, in regard to the process and temperature variations, these voltages follow the effective control voltage (Vgt) and keep a constant distance (safety reserve) to it. In particular, it is possible to greatly reduce the safety reserve and consequently increase the dynamic range of the overall circuit. For the circuits shown in FIG. 1 and FIG. 2 this "synchronism" of drain voltage Vx and effective control voltage (Vgt) is not provided or is only provided in a restricted way. Rather, in these circuits the threshold voltage Vth of the FETs always influences the drain voltage Vx of the current source 10. However, since the threshold voltage Vth has a completely different process and temperature dependence than the effective control voltage Vgt, synchronism may hardly be achieved. In the circuit shown in FIG. 2, the quality of adjustment is made even worse by the variation of the resistor R.

In the present invention, a reference stage is provided, formed by a pair of reference FETs, which are operated in saturation and using current densities which differ by a predetermined factor, so that reference gate potentials are provided at the gates of these reference FETs which are a function of the effective control voltages of the reference FETs, which form the basis of an optimized operating point adjustment of the current source. Furthermore, a processing stage is provided, into which the reference gate potentials are input in order to provide an adjustment potential on the basis of the predetermined factor, which is equal to the effective control voltage plus a predetermined additional voltage (safety reserve). This processing may be implemented in many ways, e.g., using an analog computer arrangement, e.g., using operational amplifiers. Finally, an output FET is provided which is connected on the source side to the adjustment potential and is dimensioned for current density at least approximately equal to the second current source FET and at whose gate the gate potential of the second current source FET (cascode) to be adjusted is provided. Therefore, independently of process and temperature variations, practically optimum gate potentials may be provided for the current source. In a preferred embodiment, the gate potential of the first reference FET is used as the gate potential of the first current source FET.

The measures specified in Claims 2, 3, and 4 are advantageous in regard to the precision and reliability of the operating point adjustment.

An especially simply constructed and reliable processing stage may be implemented as specified in Claim 5, in particular using one, more than one, or all of the embodiments specified in Claim 6.

The measures specified in Claim 7 advantageously lead to a double function of the output FET, specifically generating the necessary second gate potential and supplying an additional current for exact addition of an additional voltage to the threshold voltage at a resistor.

The present invention is described further in the following on the basis of an exemplary embodiment with reference to the attached drawing.

FIG. 1 shows a cascoded current source and an adjusting circuit for adjusting the operating point of the cascoded current source, FIG. 2 shows a cascoded current source and a modified adjusting circuit for adjusting the operating point of the cascoded current source, and FIG. 3 shows a cascoded current source and an adjusting circuit for adjusting the operating point of the cascoded current source according to the present invention.

FIGS. 1 and 2 were already described above in regard to the problems in adjusting a cascoded current source. Reference is explicitly made to this description for the following description of an exemplary embodiment of the present invention.

The right part of FIG. 3 again shows a cascoded current source 10, which is formed by a first current source FET Q1 and a second current source FET Q2 (cascode), the first current source FET Q1 being connected on the source side to a first supply voltage GND. An adjusting circuit 20 shown in the left part of the figure is used for the purpose of generating gate potentials Vg1, Vg2 for the FETs Q1, Q2 and/or a drain voltage Vx of the FET Q1 which is slightly above an effective control voltage Vgt1 of the FET Q1.

A reference stage is formed by an arrangement, operated in parallel, of diode-switched reference FETs M2 and M1, which are connected on the source side to the supply potential GND. The MOS diodes M2 and M1 have a reference current Iref1 or Iref2, respectively, applied to them by current sources which are each positioned between a second supply voltage VDD and one of the two drains. However, in M1 the channel width and/or the reference current is selected in such a way that the current density is $N^2$ times greater than in M2. In the example shown, the reference currents Iref1, Iref2 are selected to be equally large and the FETs M1, M2 are dimensioned in the channel width ratio $N^{-2}$:1. Since the effective control voltage Vgt is approximately proportional to the square root of the current density, M1 has an effective control voltage which is N times higher than M2. The voltage at the drain of M2 is equal to the sum of threshold voltage Vth (dependent on the technology) and effective control voltage Vgt, while a voltage having the value Vgt*N+Vth is applied at the drain of M1. These two drain voltages form the reference gate potentials Vgs1, Vgs2 provided by the reference stage.

A processing stage having FETs M3, M4, M5, M6, M7, M8 and three resistors of equal value R is provided downstream from the reference stage. With the aid of the source follower M3, M4, the threshold voltage Vth is initially derived in a first approximation from the two drain voltages cited, and two currents (drain currents of M4 and M3) are then generated in connection with the two resistors R in the left of the figure, which are proportional to Vgt and N*Vgt, respectively. These resistors are each positioned between one of the sources and the supply potential GND. High precision of this processing step results if M3, M4 are dimensioned for at least approximately equal current density and their transconductances are each greater than the reciprocal of the resistor R (particularly at least 3 times as large) and their effective control voltage is smaller than that of M2.

Using one of the cascoded current mirrors M5, M6, M7, M8 (as shown in FIG. 3) these two currents are then subtracted from one another using weighting in such a way that the resulting output current (drain current of M8) behaves proportionally to the effective control voltage Vgt over process and temperature variations.

This current mirror functions as follows: the current flowing over M5 and M7 is proportional to N*Vgt. Since M5 is dimensioned relative to M6 in the ratio N:2, e.g., has a channel width larger by the factor N/2, the current flowing through M6 and M8 is proportional to 2*Vgt. The FETs M7 and M8 are used in this case as cascodes of the current mirror to achieve a high output impedance. A node which is connected to M4 is positioned between the FETs M6 and M8, so that the current flowing through M8 (result current) results as the difference of the current, proportional to 2*Vgt, through M6 and the current, proportional to Vgt, through M4, and is therefore proportional to Vgt.

This output current of the current mirror then flows via the further resistor of equal value R, positioned between the output of the current mirror and the supply potential GND, at which the effective control voltage Vgt therefore initially drops. Since, however, this resistor additionally has a predetermined current Iref3 of a further current source applied to it via a node 22, it is possible to provide an additional safety reserve (voltage V1), which is defined by Iref3, for the drain voltage Vx. Using the FET M9, which is dimensioned in such a way that it has the same gate-source voltage as the cascode Q2 (equal current density), the second gate potential Vg2 is now generated (at the gate of M9). The drain of M9 is connected via the current source Iref3 to the second supply potential VDD. The saturation of M9 is ensured by a connection between gate and drain (diode circuit). The source of M9 is connected via the resistor R to the first supply potential GND, the node 22, at which the output current of the current mirror and the current Iref3 are added, being provided between this FET and the resistor.

The component of the current through R, which corresponds to the safety reserve V1, may be different from the current through M9, notwithstanding the exemplary embodiment shown, if a further current source and/or sink is connected to the node 22.

The operating point of the cascoded current source 10 may be adjusted in such a way that the drain voltage Vx has an interval (in the example shown: V1=R*Iref3) to the effective control voltage Vgt which is independent of process and temperature, through which the safety reserve, which is necessary to keep the current source Q1, Q2 in saturation under all operating conditions, may be designed to be minimal. In this way, the dynamic range of the current source 10 may be elevated, above all for low supply voltages (in this case: VDD−GND).

The circuit shown in FIG. 3 therefore adjusts the drain voltage of the first current source FET Q1 in that it first determines the effective control voltage Vgt of the current source Q1, Q2 (with the aid of the replication M2) and then adds a constant safety reserve V1 thereto.

In the exemplary embodiment shown, the gate potential Vg1 of the FET Q1 is provided in a very simple way by the gate potential of the reference FET M2. However, this is in no way required. For example, Vg1 may also be provided by the gate voltage of a replication of M2.

In summary, an integrated circuit arrangement was described, including a cascoded current source (10) and adjusting circuit (20) for adjusting the operating point (Vg1, Vg2, Vx) of the cascoded current source (10) by providing gate potentials (Vg1, Vg2) for current source FETs (Q1, Q2), the adjusting circuit having:

a reference stage, formed by a pair of reference FETs (M2, M1), which are supplied with reference currents (Iref1, Iref2) in such a way that the current densities in the reference FETs (M2, M1) differ from one another by a predetermined factor ($N^2$), for providing reference gate potentials (Vgs1, Vgs2) at the gates of the reference FETs (M2, M1), a processing stage for providing an adjustment potential (Vgt1+V1) on the basis of the predetermined factor ($N^2$), which is equal to the effective control voltage (Vgt1) of a reference FET (M2) plus a predetermined additional voltage (V1), and an output FET (M9), which is connected on the source side to the adjustment potential (Vgt1+V1).

Therefore, the present invention provides a circuit for operating point adjustment of a cascoded FET current source which is independent of process and temperature, which may be used in many highly integrated analog circuits, and which maximizes the dynamic range.

What is claimed is:

1. An integrated circuit arrangement, including a cascoded current source (10) for providing an output current (Iout), which is formed by a series circuit of a first current source FET (Q1), connected on the source side to a supply voltage (GND) and a second current source FET (Q2), situated as a cascode, which are operated in saturation, and an adjusting circuit (20) for adjusting the operating point (Vg1, Vg2, Vx) of the cascoded current source (10) by providing a first gate potential (Vg1) and a second gate potential (Vg2) for the first current source FET (Q1) and/or the second current source FET (Q2), wherein the adjusting circuit has:

a reference stage, which is formed by a pair of a first reference FET (M2) and a second reference FET (M1), which are operated in saturation and connected on the source side to the supply voltage (GND) and which are supplied with a first reference current (Iref1) and a second reference current (Iref2), respectively, the reference FETs (M2, M1) being dimensioned in such a way and the reference currents (Iref1, Iref2) being selected in such a way that the current density in the second reference FET (M1) differs by a predetermined factor ($N^2$) from the current density in the first reference FET (M2), for providing a first reference gate potential (Vgs1) and a second reference gate potential (Vgs2) at the gate of the first reference FET (M2) and/or at the gate of the second reference FET (M1), a processing stage, into which the first reference gate potential (Vgs1) and the second reference gate potential (Vgs2) are input, for providing an adjustment potential (Vgt1+V1) on the basis of the predetermined factor ($N^2$), which is equal to the effective control voltage (Vgt1) of the first reference FET (M2) plus a predetermined additional voltage (V1), and an output FET (M9), operated in saturation, which is connected on the source side to the adjustment potential (Vgt1+V1) and is dimensioned in such a way that the current density in the output FET (M9) is at least approximately equal to the current density in the second current source FET (Q2), the potential at the gate of the output FET (M9) being provided as the second gate potential (Vg2).

2. The circuit arrangement according to claim 1, wherein the predetermined factor ($N^2$) in the reference stage is in the range from approximately 2 to 100.

3. The circuit arrangement according to claim 1, wherein the first reference current (Iref1) and the second reference current (Iref2) in the reference stage are at least approximately equal.

4. The circuit arrangement according to claim 1, wherein the first reference FET (M2) is an at least approximately equally dimensioned replication of the first current source FET (Q1).

5. The circuit arrangement according to claim 1, wherein the processing stage has:

a voltage-current converter for converting the first reference gate potential (Vgs1) and the second reference gate potential (Vgs2) into currents, whose values are each proportional to the reference gate potentials (Vgs1, Vgs2), reduced by a threshold voltage (Vth), and differ from one another as a function of the predetermined factor ($N^2$), a current mirror for weighted subtraction of these currents and for providing a result current corresponding to the result of the weighted subtraction, whose value is proportional to the effective control voltage (Vgt1), and a current-voltage converter for converting the result current into a voltage which is equal to the effective control voltage (Vgt1) of the first reference FET (M2) and for adding the predetermined additional voltage (V1) to this voltage, or for converting the result current, increased by an additional current (Iref3), into a voltage which is equal to the effective control voltage (Vgt1) of the first reference FET (M2) plus a predetermined additional voltage (V1), in order to provide the adjustment potential (Vgt1+V1).

6. The circuit arrangement according to claim 5, wherein the processing stage has:

a parallel arrangement of a first processing FET (M4) and a second processing FET (M3), which are each connected on the source side to the supply potential (GND)

via a resistor (R) and are operated in saturation, the current density provided in the processing FETs (M4, M3) being at least approximately equal in order to provide processing currents which are each in a fixed ratio to the effective control voltage (Vgt1) of the first reference FET (M2) and are in a fixed ratio to one another which corresponds to the square root of the predetermined factor ($N^2$), a cascoded current mirror (M5, M6, M7, M8) for weighted subtraction of the processing currents in such a way that a result current is provided at an output of the current mirror which is in a fixed ratio to the effective control voltage (Vgt1) of the first reference FET (M2), an addition node (22) for adding the result current and a predetermined additional current (Iref3), and a resistor (R), via which the added current is guided in order to provide the adjustment potential (Vgt1+V1) as the voltage drop at the resistor.

7. The circuit arrangement according to claim 1, wherein the output FET (M9) is connected on the source side via a resistor (R) to the supply potential (GND), at which the adjustment potential (Vgt1+V1) drops, a component of a current flow which corresponds to the predetermined additional voltage (V1) being guided through the resistor (R) via the output FET (M9).

* * * * *